US005938571A

United States Patent [19]

Stevens

[11] Patent Number: 5,938,571

[45] Date of Patent: Aug. 17, 1999

[54] FOLDING EXERCISE MACHINE

[76] Inventor: Clive Graham Stevens, 7F, No. 291 Ta Tun 4th St., P.O. Box 19-78, Taichung, Taiwan

[21] Appl. No.: 08/890,081

[22] Filed: Jul. 9, 1997

[51] Int. Cl.[6] ..... A63B 21/068

[52] U.S. Cl. ..... 482/96; 482/135; 482/142

[58] Field of Search ..... 482/72, 95, 96, 482/101, 132–135, 142; 152/313

[56] References Cited

U.S. PATENT DOCUMENTS

| | | | |
|---|---|---|---|
| 2,676,015 | 4/1954 | Courtney | 482/142 |
| 2,783,045 | 2/1957 | Bosch | 482/96 |
| 2,817,522 | 12/1957 | Margulies . | |
| 3,315,667 | 4/1967 | Yoder | 482/142 |
| 3,394,934 | 7/1968 | Elia et al. . | |
| 3,651,911 | 3/1972 | Kornylak | 152/313 |
| 3,658,327 | 4/1972 | Thiede . | |
| 3,716,230 | 2/1973 | Mark | 482/142 |
| 3,892,404 | 7/1975 | Martucci . | |
| 4,004,801 | 1/1977 | Campanaro et al. | 482/96 |
| 4,341,378 | 7/1982 | Agyagos | 482/142 |
| 4,383,684 | 5/1983 | Schliep | 482/96 |
| 4,700,946 | 10/1987 | Breunig | 482/96 |
| 4,723,774 | 2/1988 | Monforte . | |
| 4,826,152 | 5/1989 | Lo . | |
| 4,826,157 | 5/1989 | Fitzpatrick . | |
| 4,828,255 | 5/1989 | Lahman | 482/142 |
| 4,911,438 | 3/1990 | Van Straaten . | |
| 5,066,005 | 11/1991 | Luecke | 482/96 |
| 5,169,363 | 12/1992 | Campanaro et al. . | |
| 5,328,424 | 7/1994 | Greco | 482/72 |
| 5,334,120 | 8/1994 | Rasmussen . | |
| 5,433,685 | 7/1995 | Winslow et al. | 482/96 |
| 5,620,403 | 4/1997 | Lundin . | |
| 5,674,168 | 10/1997 | Wilkinson | 482/72 |
| 5,752,879 | 5/1998 | Berdut | 482/96 |

OTHER PUBLICATIONS

Total Gym booklet, published by Total Gym Fitness, Ltd. 1997.

Physiq Tri Gravity Training Manual, published by Physiq, Inc. 1994.

*Primary Examiner*—Richard J. Apley
*Assistant Examiner*—Victor K. Hwang
*Attorney, Agent, or Firm*—Norman E. Lehrer

[57] ABSTRACT

An exercise machine has a frame with parallel rails and a glide board slidably mounted upon the frame and having a plurality of wheels defining concave surfaces in rolling engagement upon the parallel rails. The wheels have a relatively hard roller and an outer tire of resilient material defining the concave surface.

6 Claims, 11 Drawing Sheets

FOLDING EXERCISE MACHINE

BACKGROUND OF THE INVENTION

The present invention is directed toward gravity exercise trainers suitable for use in the home, and more particularly, to exercise machines having a glide board mounted on inclined rails.

Exercise machines with an inclined board slidably mounted on a support, on which the user exercises against his or her own weight, are well known in the art. See, for example, Van Straaten U.S. Pat. No. 4,911,438, Campanaro U.S. Pat. No. 5,169,363 and Lundin U.S. Pat. No. 5,620,403.

Van Straaten and Lundin describe exercise machines including a board slidably mounted on an inclined rail which is movably connected at one end to an upright post. The inclination of the inclined rail can be adjusted by moving the connected end up or down along the post. These machines require a complicated housing to connect the inclined rail to the post into which fingers or other objects may be jammed. Also, folding for storage can be accomplished only through the awkward process of raising up the entire length of the inclined rail frame with the sliding board attached.

Campanaro describes a similar machine in which the board is slidably mounted on two inclined rails which are movably connected to an upright support structure. The inclination of the inclined rails is adjusted by attaching them to fixed hooks mounted to the upright support structure. Adjustment of the inclination of the inclined rails is awkward on this machine and the machine is unstable in that the inclined rails can be dislodged from the hooks with a relatively small amount of force. It is also incapable of folding or storage as a single compact unit.

Foldable gravity trainers are known to the art. For example, the Total Gym manual, published by Total Gym Fitness, Ltd, describes an exercise machine with a board slidably mounted on a pair of inclined rails. The inclination of the rails can be adjusted by moving one end along an upright post and locking the rails into place with a locking pin. The exercise machine may be folded by lowering the rails so that they are approximately horizontal, and folding them at a hinge located near the midpoint of the rails.

The exercise machine described in the Total Gym manual, if used improperly, can produce serious injury. For example, if the user attempts to fold the machine while holding one of the rails near the folding hinge, it is fairly easy for the user to catch his or her finger between the rails as they fold together, resulting in serious injury to the finger.

Injury may also occur if the user attempts to operate the machine while the rails are in the lowest (i.e. approximately horizontal) position, as this configuration can permit the upright post to fall toward the board and the user thereon.

It is also known to use hard plastic or metallic wheels having concave outer surfaces for mounting sliding boards upon rails of exercise machines. Such wheels are useful because they can resist movement of the sliding board other than along the axes of the rails. However, these wheels often provide an uncomfortable ride when used to roll on a hard metallic rail surface which is not chrome plated.

Wheels having a resilient convex outer surface are known in the art. However multiple opposing wheels must be used to hold a sliding board to a rail.

SUMMARY OF THE INVENTION

According to one aspect of the invention, an exercise machine comprises a frame comprising a plurality of parallel rails, and a glide board slidably mounted upon the frame and having a plurality of wheels defining concave surfaces in rolling engagement upon the parallel rails, the wheels comprising a relatively hard roller and an outer tire of resilient material defining the concave surface.

According to another aspect of the invention, a foldable exercise machine comprises an upright post mounted to a transverse base bar, a folding frame having a first end movably mounted to the upright post and having a transverse hinge member spaced from the first end, and an extensible locking brace having a first end pivotally connected to the transverse base bar and a second end pivotally connected to the folding frame in a region of the transverse hinge member, the extensible locking brace comprising an inner strut, an outer strut in slidable engagement with the inner strut and a locking pin disposed for securement of the inner strut with the outer strut.

According to another aspect of the invention, a folding exercise machine comprises a folding frame having a first end and a second end, and comprising a transverse hinge member spaced from the first end and the second end, a handle rotatably mounted in a region of the transverse hinge member for exerting an upward force on the transverse hinge member, and a plurality of folding rails.

In a preferred embodiment of this aspect of the invention, the folding exercise machine has a locking member and a handle disposed for locking engagement with the locking member when the exercise machine is folded to a storage position.

According to another aspect of the invention, an exercise machine has an upright post mounted to a transverse base bar, a rail slider movably and snugly mounted to the upright post and a folding frame comprising two rails, each rail having a transverse tube member in fixed engagement with the rail slider, which is adapted for movement along the upright post for positioning of the rails along a selection of inclined positions.

In a preferred embodiment of this aspect of the invention, the selection of inclined positions includes a position which is approximately horizontal.

According to another aspect of the invention an exercise machine has a frame comprising a plurality of parallel rails and a transverse member positioned transversely to said rails, a glide board slidably mounted upon said rails, said glide board having hooks positioned to engage said transverse member so as to resist dislodgement of said glide board from said rails when said rails are in a non-horizontal position, and permit free movement of said glide board along the length of said rails.

Objectives of the present invention include to provide an inclined plane exercise machine which can be safely used when the inclination is made approximately horizontal, to provide a foldable rail exercise machine which can be folded without placing the user's hands on the rails, to provide an inclined plane exercise machine having a simplified inclination adjustment mechanism without spaces or moving parts, and to provide a sliding board having wheels with a concave resilient outer surface.

DESCRIPTION OF THE PREFERRED EMBODIMENTS

Figure 1:
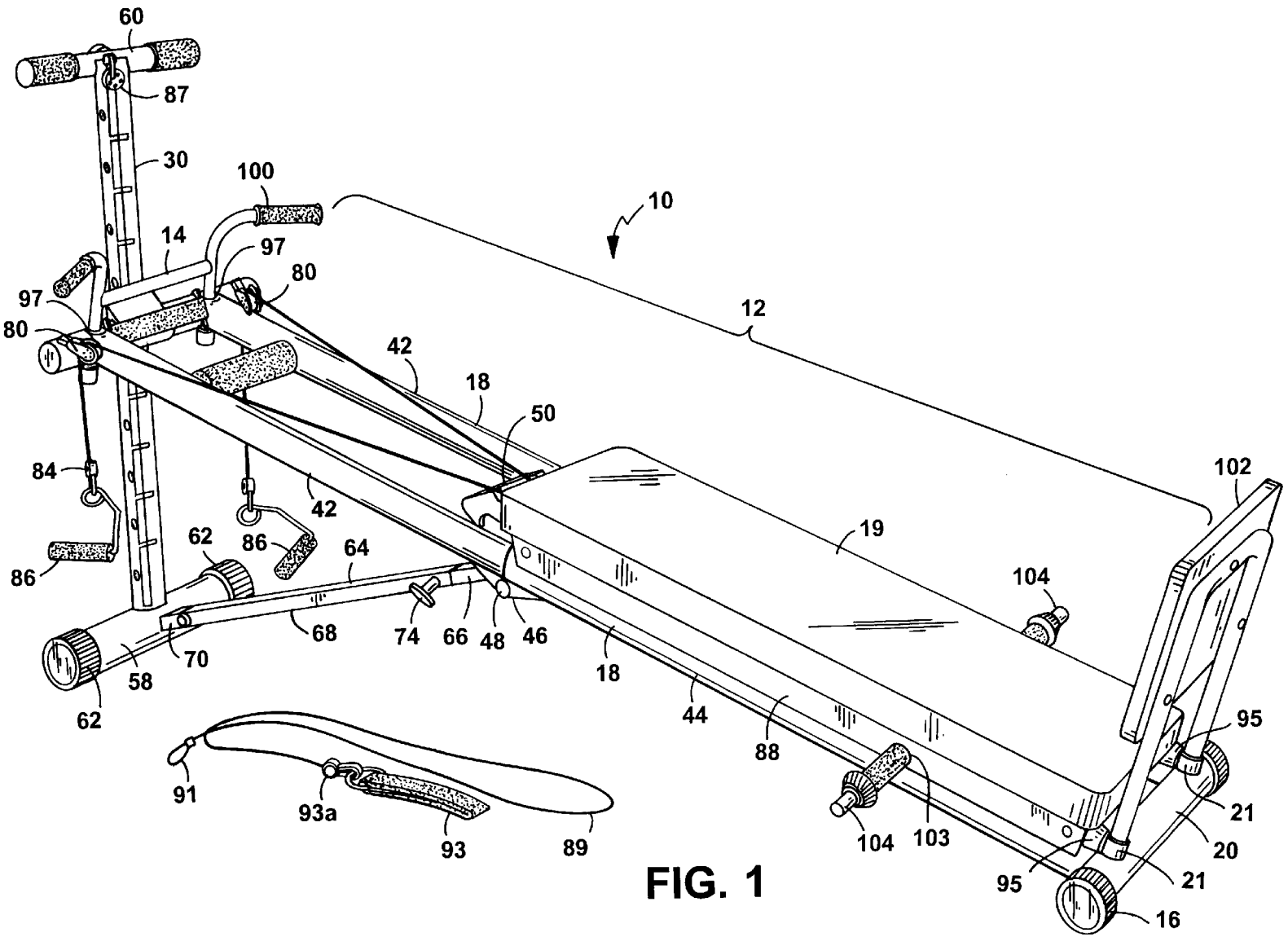
FIG. 1 is a perspective view of the exercise machine according to the invention.

Referring now to the drawings, there is shown in FIG. 1 a sliding exercise machine constructed in accordance with the principles of the present invention and designated generally as 10.

The sliding exercise machine 10 includes an incline frame 12, having an upper end 14 and a lower end 16. The incline frame 12 includes incline rails 18 upon which a glide board 19 is slidably mounted. The incline rails 18 are connected by a lower cross bar member 20 positioned perpendicular to the rails at the lower end 16 of the incline frame 12. Mounted on lower cross bar member 20 are stops 21. In a preferred embodiment, stops 21 are hollow and adapted to receive various accessory attachments, as described in more detail below.

Figure 2:
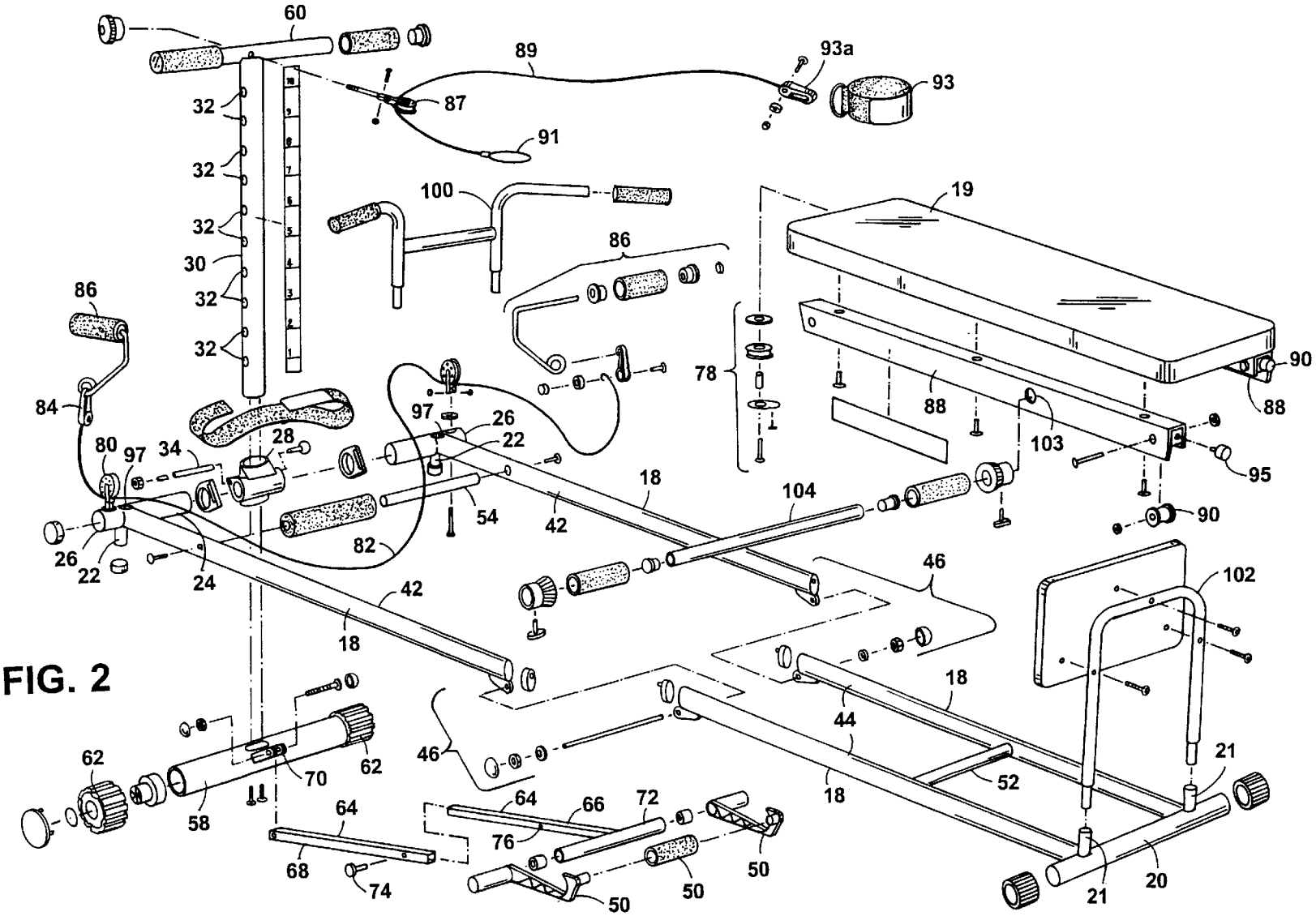
FIG. 2 is an exploded view of the exercise machine of FIG. 1.

Referring also to FIG. 2, at the upper end of each incline rail 18 there are secured transverse tube members 22, each having an inner section 24 and an outer section 26. The rail slider 28 is adapted to receive simultaneously the inner section 24 of each transverse tube member 22. The rail slider 28 is movably mounted to resistance rail or upright post 30, which passes snugly through rail slider 28, so that the slider can move along resistance rail 30 in a generally vertical direction.

Resistance rail 30 defines a series of spaced locking holes 32 located along the length at one side. Rail slider 28 includes a spring biased locking pin 34, which is adapted to engage with any one of locking holes 32 to lock rail slider 28 into place with respect to resistance rail 30. In a preferred embodiment, auxiliary locking pin 36 is adapted to pass through a corresponding hole (not shown) on the opposite side of rail slider 28 from locking pin 34, and to engage with auxiliary locking holes (not shown), which are located at the same height but on the opposite side of resistance rail 30 from locking holes 32.

Figure 3A:
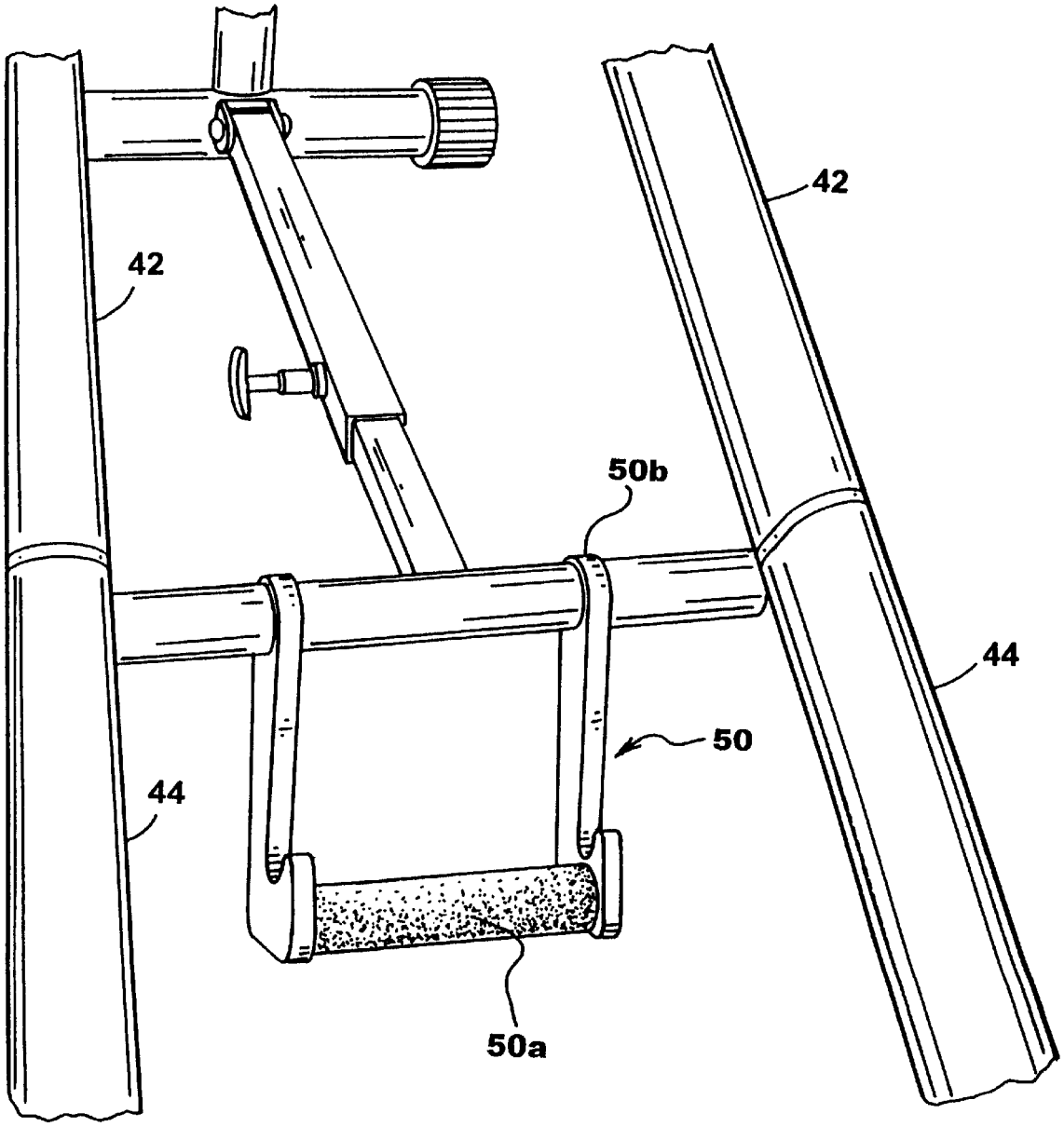
FIG. 3*a* is a top partial view of the exercise machine of FIG. 1
Figure 3B:
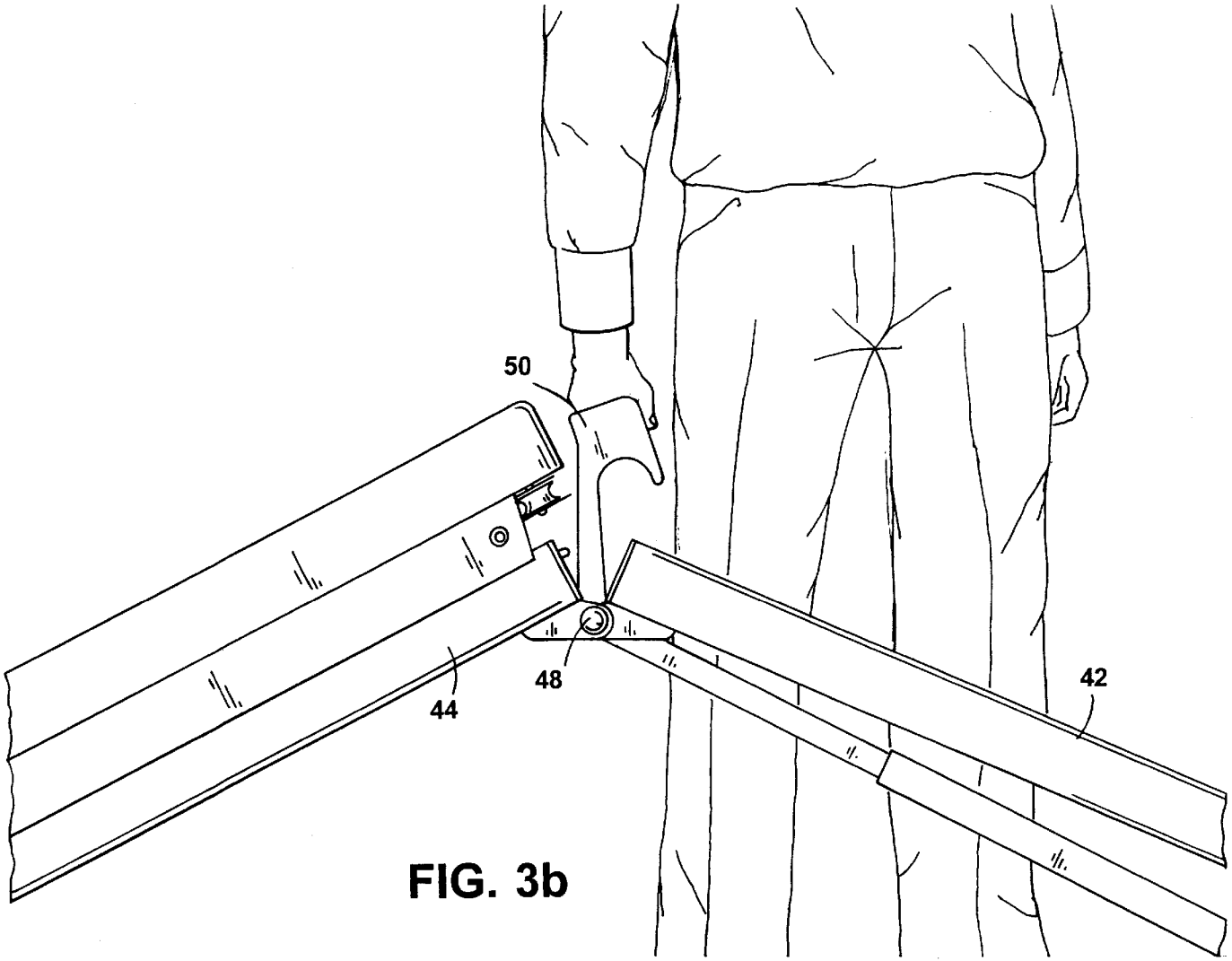
FIG. 3*b* is a partial side view of the exercise machine of FIG. 1, showing the machine in a partially folded configuration.

Referring again to FIGS. 1 and 2, each of the incline rails 18 includes an upper member 42 and a lower member 44. The upper and lower members are joined by hinge assembly 46 mounted to the underside thereof. Hinge assembly 46 includes transverse hinge member 48 to which storage handle 50 is rotatably connected. As seen in FIG. 3A, the handle has a distal free end 50*a* for grasping by a user and a lower end 50*b* rotatably mounted to the transverse hinge member 48. Transverse hinge member 48 pivotally connects each lower member 44 to the corresponding upper member 42 in a manner to permit them to be folded together. Referring to FIGS. 3*a* and 3*b*, storage handle 50 is adapted for pulling upward on transverse hinge member 48 so as to cause upper members 42 and lower members 44 to fold together.

Incline rails 18 are also connected by a transverse hooking member 52, located at a region approximately midway between the transverse hinge member 48 and lower cross bar member 20.

In a preferred embodiment, incline rails 18 are also connected by a transverse heel rest bar 54, positioned at a distance, e.g. approximately one foot, from rail slider 28.

The rail slider 28 is slidably connected to resistance rail 30. Secured to the bottom of resistance rail 30 is transverse base bar 58. Mounted on the top of resistance rail 30 is transverse top bar 60.

Wheels 62 are attached to the transverse base bar 58. These wheels are sufficiently rotatable to facilitate movement of the machine along the floor during folding and storage, but are sufficiently resistant to rotation to resist accidental movement during use of the machine.

Connecting transverse hinge member 48 and transverse base bar 58 is an extensible locking brace 64, which includes an inner strut 66 and an outer strut 68. Outer strut 68 is pivotally connected at one end to transverse base bar 58 by hinge 70. At its other end, outer strut 68 cooperatively receives the free end of inner strut 66, which is connected at its other end to sleeve 72, mounted in turn on transverse hinge member 48 in a manner to permit it to rotate freely about its axis.

Outer strut 68 includes a spring biased locking pin 74 adapted to cooperatively engage with a locking hole 76 in inner strut 66, to restrict inner strut 66 from sliding within outer strut 68.

A central pulley 78 is positioned at the upper end of glide board 19. One each of a pair of spaced apart secondary pulleys 80 is secured to the transverse tube members 22. Cord 82 extends around central pulley 78 and each end of the cord is engaged around a corresponding secondary pulley 80. A clip 84 at each end of the cord connects the cord to a handle 86.

In a preferred embodiment, auxiliary pulley 87 may be removably mounted on transverse top bar 60. Auxiliary cord 89, having fixed loop 91 and leg cuff 93 attached thereto by clip 93*a*, is positioned around auxiliary pulley 89 with loop 189 placed around central pulley 78, permitting a user to pull glide board 19 using his or her legs, using leg cuff 93.

Figure 4A:
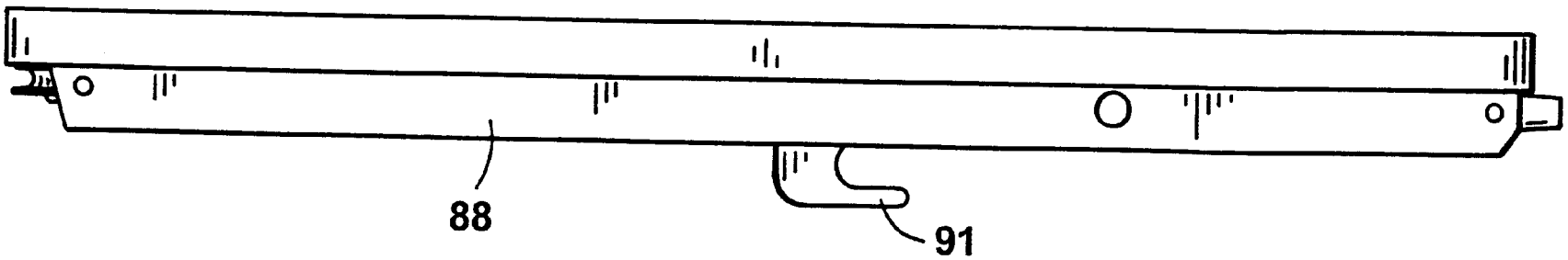
FIG. 4*a* is a side view of the glide board according to the invention.
Figure 4B:
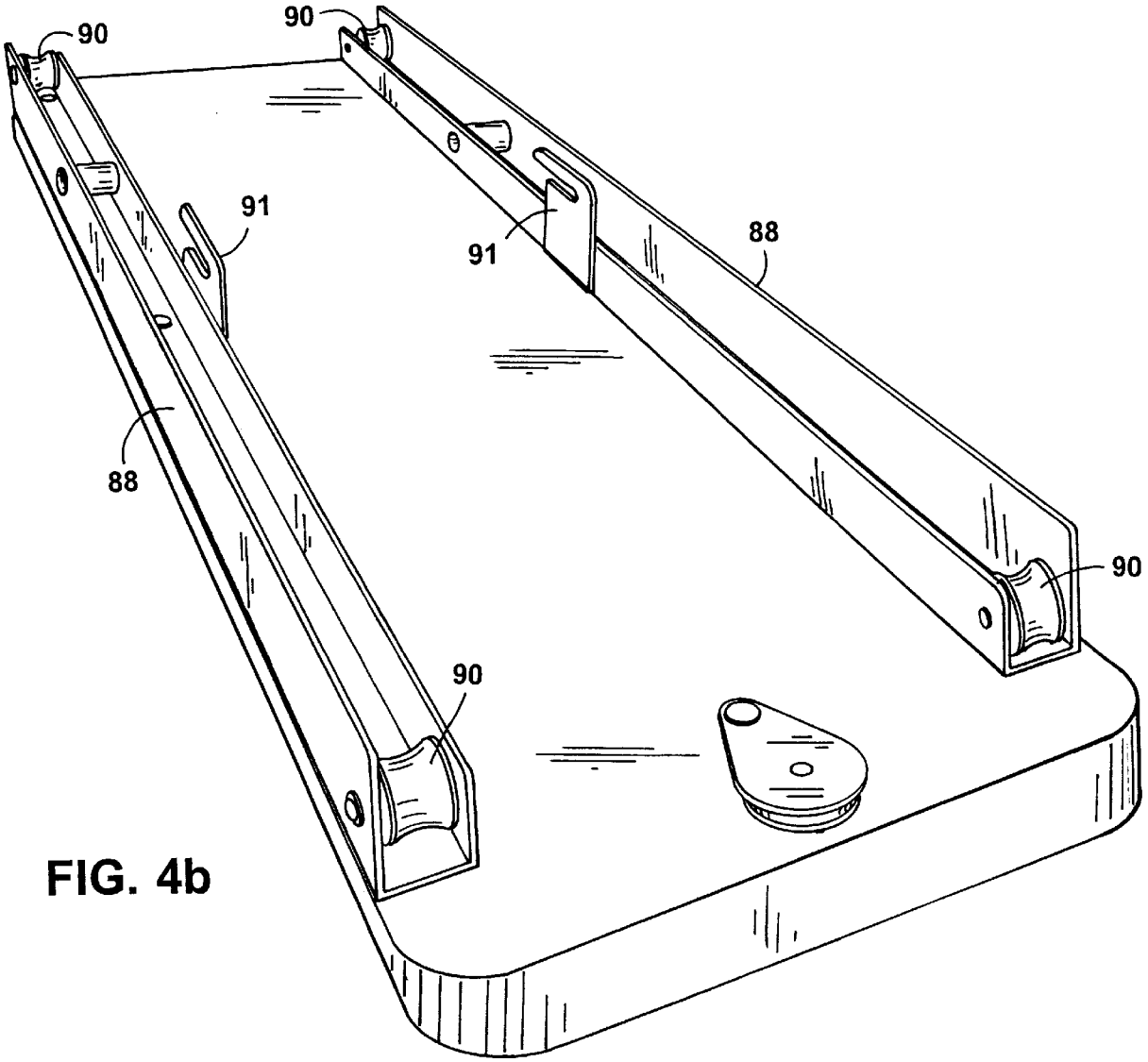
FIG. 4*b* is an underside view of the glide board according to the invention.

Mounted along the long edges of the underside of glide board 19 are glide housings 88. Referring also to FIGS. 4*a* and 4*b*, mounted at opposite ends of each glide housing 88 are glide wheels 90. Mounted at approximately the median point of glide board 19 are hooks 91, which are adapted to cooperatively engage with transverse hooking member 52 when the lower end of the glide board 19 reaches stops 21, thus restricting glide board 19 from falling away from lower members 44 when they are positioned in a nonhorizontal position for storage.

Referring again to FIGS. 1 and 2, in a preferred embodiment, bumpers 95 are mounted to the lower end of glide board 19 in a position to make contact with stops 21 when glide board 19 reaches the lower end of incline frame 12. In a preferred embodiment, each glide housing 88 defines a hole 103 adapted to receive weight bar 104 adapted for mounting free weights thereon.

Figure 5A:
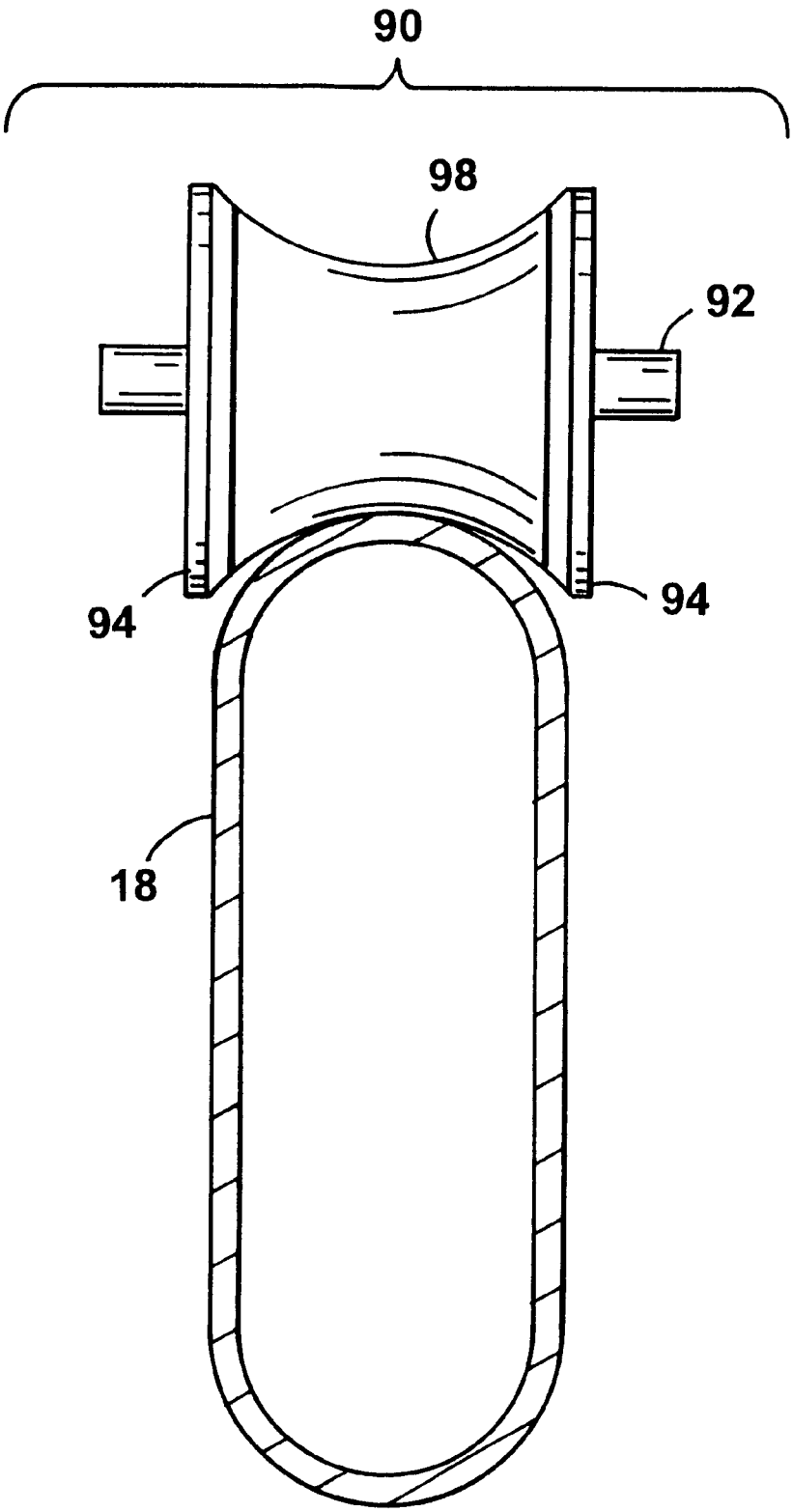
FIG. 5*a* is an end view of a concave wheel according to the invention in engagement with an inclined rail.
Figure 5C:
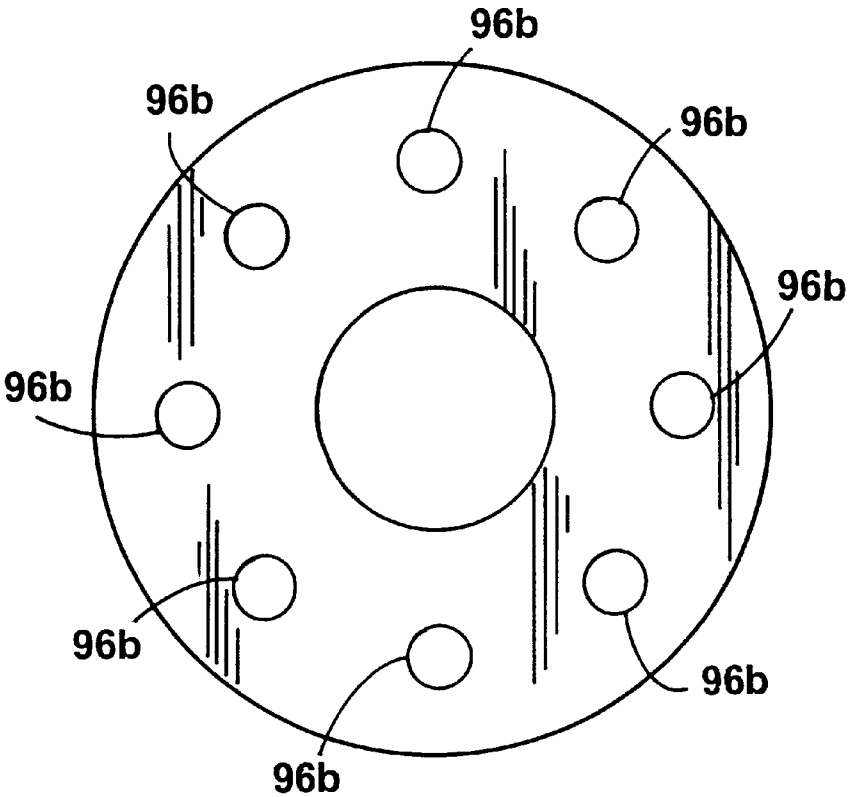
FIG. 5*c* is a side view of a glide wheel roller according to the invention.
Figure 5B:
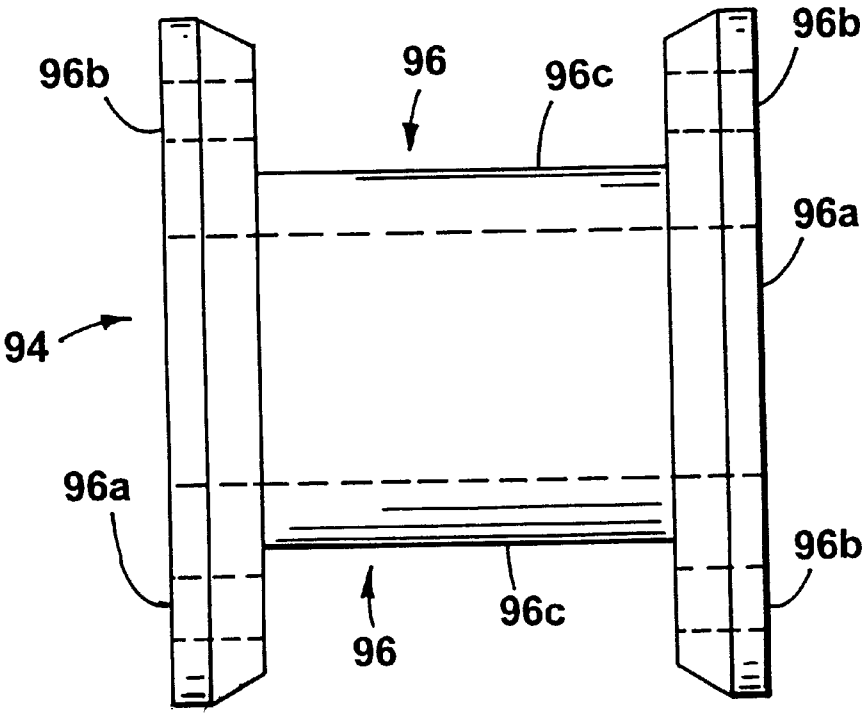
FIG. 5*b* is an end view of a glide wheel roller according to the invention.
Figure 5E:
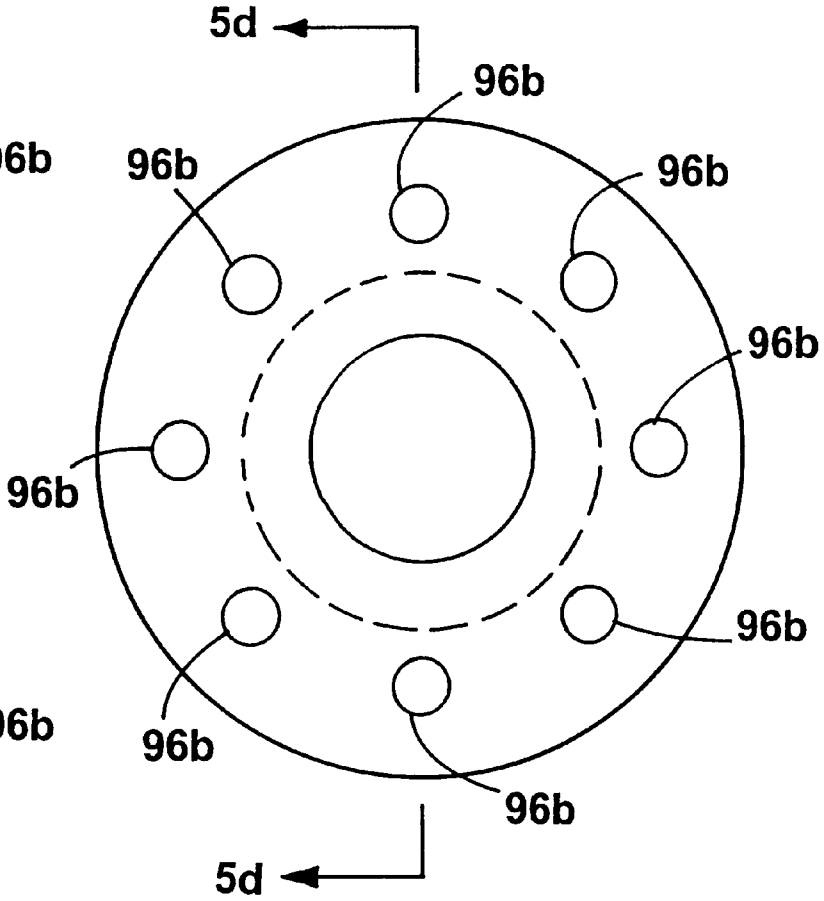
FIG. 5*e* is a side view of a glide wheel roller according to the invention.
Figure 5D:
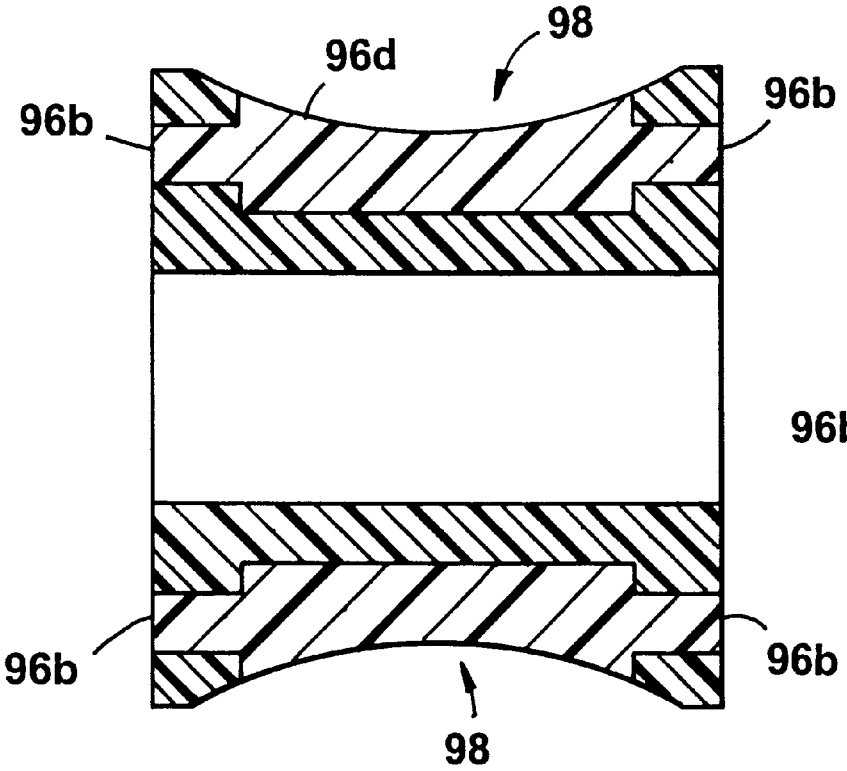
FIG. 5*d* is an end view of the glide wheel roller with a tire according to the invention, taken at the line 5*d*—5*d* of FIG. 5*e*.

Referring to FIG. 5*a*, glide wheel 90 includes axle 92, roller 94 and tire 98. Roller 94 is preferably formed of a hard, lightweight material, e.g. nylon. Tire 98 is formed of a resilient material, e.g. poly urethane. Tire 98 conforms snugly to roller 94, and is adapted to cooperatively engage with the top surfaces of incline rails 18, so as to resist transverse motion. Referring also to FIG. 5*b*, roller 94 includes a hub 96 and side walls 96*a*. Referring also to FIG. 5*c*, side walls 96*a* define holes 96*b* and cavity 96*c*. Referring also to FIGS. 5*d* and 5*e*, tire 98 is created by injecting resilient material through holes 96*b* to fill cavity 96*c*, so that outer surface 96*d* has an appropriate concave shape.

As described above, glide board 19 is slidably mounted upon the incline rails 18 so that it can move along the inclined plane formed by the rails, transporting the weight of the user for exercise. A user may sit or lie upon the glide board and perform various exercises which entail moving the glide board from a lower position to an upper position along the aforementioned inclined plane. Referring again to FIGS. 1 and 2, this may be accomplished, for example, by pulling on handles 86 connected to the glide board via cord 82 and pulley 80. In a preferred embodiment, holes 97 adapted for receiving accessories, such has pulling handles 100 or push board 102, are defined by transverse tube members 22, thus providing additional, alternative means of applying force to the glide board. In a preferred embodiment, such accessories may also be mounted on stops 21 on lower cross bar member 20.

The resistance provided by glide board 19 varies according to its angle of inclination. This angle can be adjusted by moving rail slider 28 to different, generally vertical positions along the length of resistance rail 30; and then locking rail slider 28 into place using locking pin 34. To move rail slider 28 from one position to another, the spring biased locking pin 34 is retracted and rail slider 28 is moved until the desired position is reached. Locking pin 34 is released to enter an appropriate locking hole 32, thereby to resist further movement of rail slider 28. Auxiliary locking pin 36 may also be used to further secure rail slider 28 into place and thus to provide an additional measure of safety.

Figure 6A:
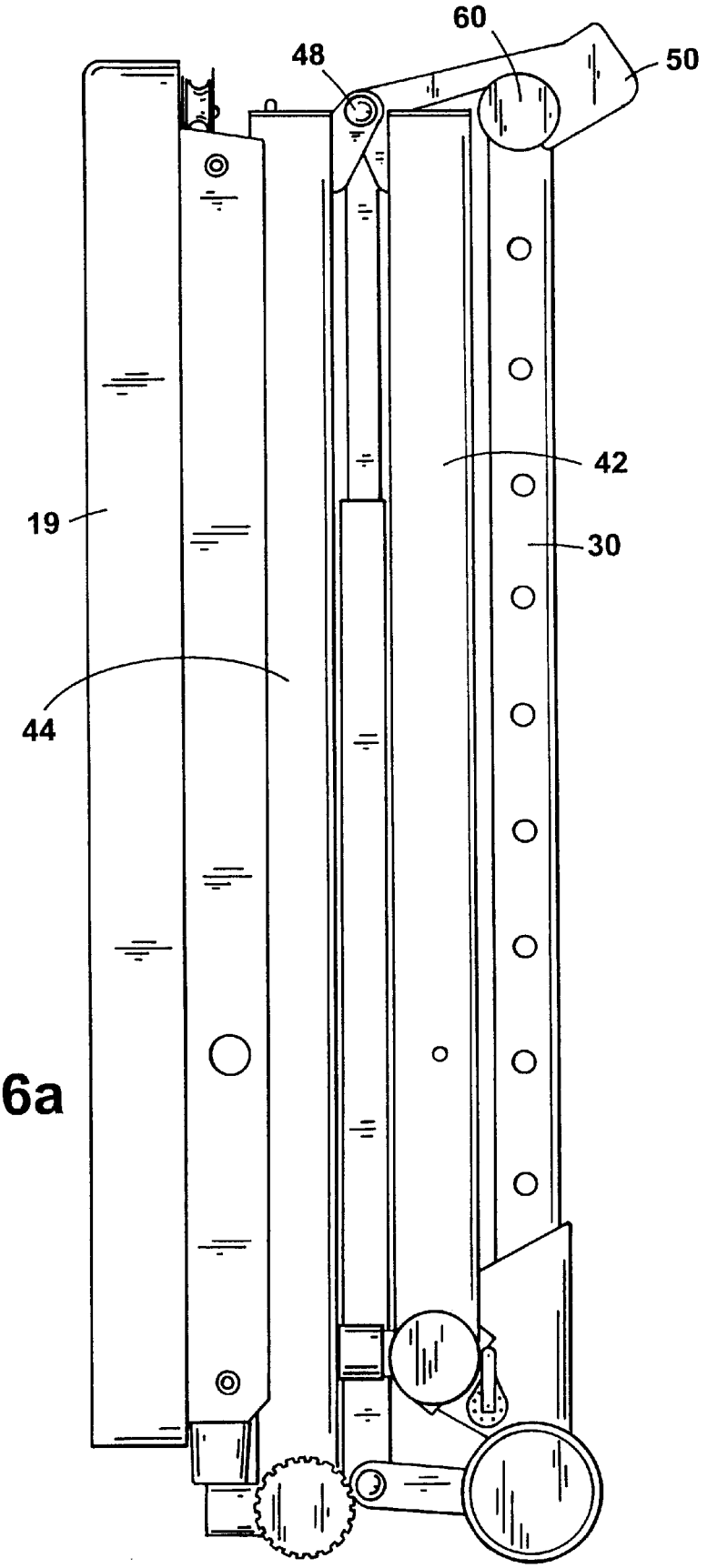
FIG. 6*a* is a perspective view of the exercise machine of FIG. 1 in folded configuration.
Figure 6B:
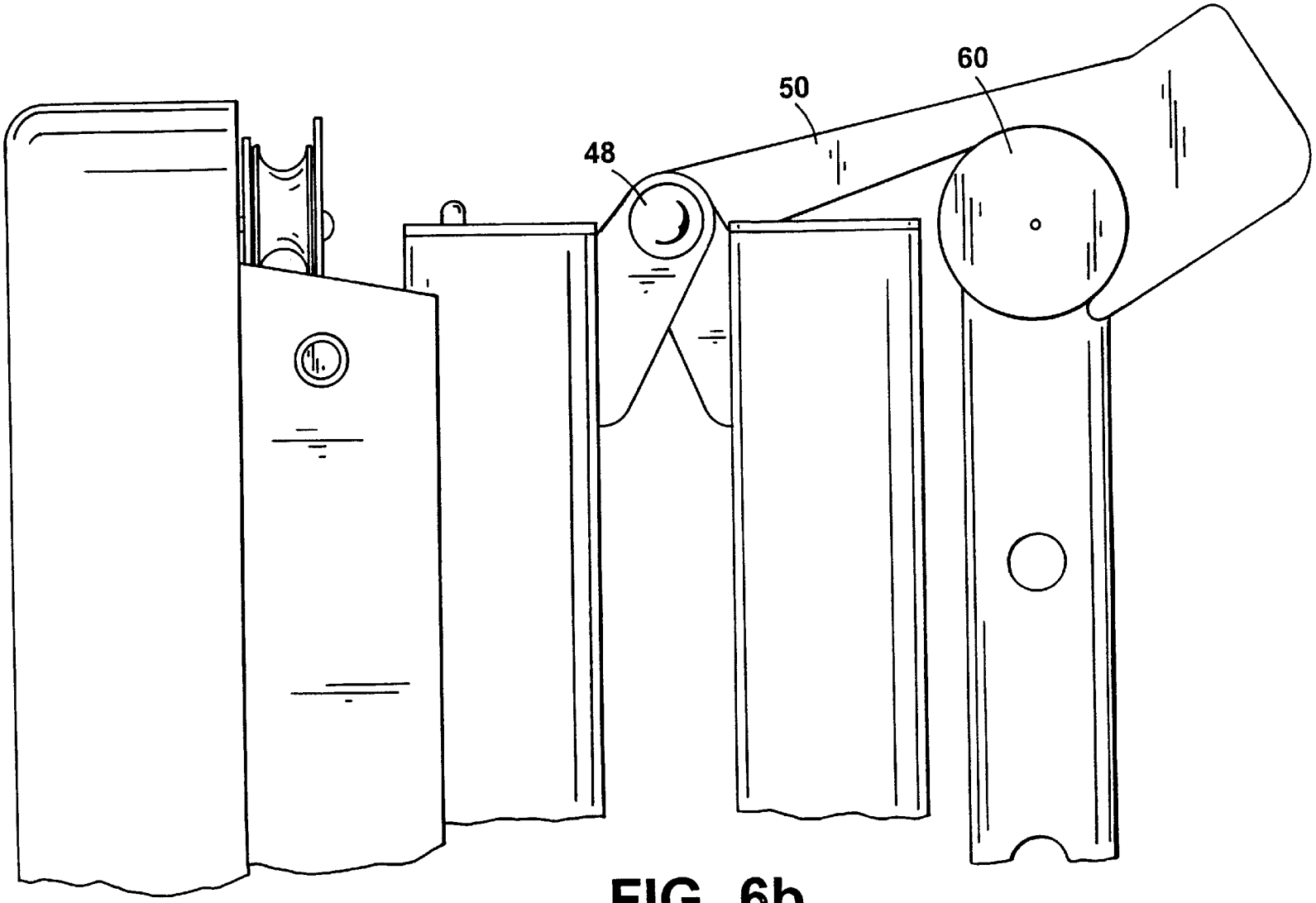
FIG. 6*b* is a perspective view of the storage handle in locking engagement with the transverse top bar of an exercise machine of the invention.

The gravity exercise machine 10 of the invention is also adapted to be folded up and stored away. This is accomplished by moving rail slider 28 to the lowest position on the resistance rail 30. Cord 82 is disengaged from central pulley 78. Locking pin 74 is retracted until inner strut 66 moves freely within outer sleeve member 68. Resistance rail 30 is pulled slightly forward to prevent locking pin 74 from reengaging with inner strut 66. Referring to FIGS. 1 and 3*b*, storage handle 50 is pulled upward and toward the top of resistance rail 30, causing incline rails 18 to fold about transverse hinge member 48. Referring to FIGS. 6*a* and 6*b*, when the exercise machine 10 is completely folded, storage handle 50 can be positioned relative to transverse hinge member 48 to clasp transverse top bar 60, thus securing the exercise machine in folded condition.

Other embodiments are under the following claims.

What is claimed is:

1. A folding exercise machine being movable between an unfolded operable position and a folded position, said machine comprising:

an upright post mounted to a transverse base bar;

a frame with an upper end, a lower end, and at least two parallel incline rails slidably mounted to said upright post for adjusting the inclination of said parallel incline rails, each of said rails having an upper member and a lower member a glide board slidably mounted upon said rails; and a hinge assembly including a transverse hinge member which pivotally connects said lower members to said upper members, respectively, and a handle having a distal free end for grasping and a lower end rotatably mounted to said transverse hinge member wherein when said handle is pulled upwardly said upper and lower members fold together, respectively.

2. The folding exercise machine as claimed in claim 1 wherein said upright post includes a transverse top bar secured to the upper portion thereof and wherein said handle includes means for securing the same to said transverse top bar when said exercise machine is in its folded position.

3. The folding exercise machine as claimed in claim 1 further including an extensible locking brace having a first end pivotally connected to said transverse base bar and a second end pivotally connected to said transverse hinge member, said extensible locking brace having an inner strut, an outer strut in slidable engagement with said inner strut, and a locking pin disposed for securement of said inner strut with said outer strut.

4. The folding exercise machine as claimed in claim 1 wherein said frame further includes a transverse member near said lower end which connects said rails.

5. The folding exercise machine as claimed in claim 4 wherein said glide board further includes a plurality of wheels defining concave surfaces in rolling engagement upon said rails.

6. The folding exercise machine as claimed in claim 5 wherein said glide board has hooks positioned to engage said transverse member in a manner to resist dislodgement of said glide board from said rails when said rails are in a non-horizontal position, and to permit free movement of said glide board along said rails.

* * * * *